US010920456B1

(12) United States Patent
Hess

(10) Patent No.: US 10,920,456 B1
(45) Date of Patent: Feb. 16, 2021

(54) SAFE LOCKING APPARATUS WITH ENHANCED STRENGTH

(71) Applicant: Randall Ray Hess, Modesto, CA (US)

(72) Inventor: Randall Ray Hess, Modesto, CA (US)

( * ) Notice: Subject to any disclaimer, the term of this patent is extended or adjusted under 35 U.S.C. 154(b) by 89 days.

(21) Appl. No.: 15/902,459

(22) Filed: Feb. 22, 2018

Related U.S. Application Data

(60) Provisional application No. 62/462,288, filed on Feb. 22, 2017.

(51) Int. Cl.
*E05B 63/00* (2006.01)
*E05B 65/00* (2006.01)
*E05G 1/04* (2006.01)

(52) U.S. Cl.
CPC ..... *E05B 65/0075* (2013.01); *E05G 1/04* (2013.01)

(58) Field of Classification Search
CPC .... E05B 65/0075; E05B 63/126; E05B 63/00; E05B 63/02; E05G 1/04
USPC ..... 70/130; 292/3–7, 37; 109/59 R
See application file for complete search history.

(56) References Cited

U.S. PATENT DOCUMENTS 2,473,065 A * 6/1949 Miller ..... E05C 9/06 292/37
3,527,069 A * 9/1970 Tumbiolo ..... E05C 9/043 70/114
7,428,835 B2 * 9/2008 Fan ..... E05B 63/0017 312/223.2
8,469,408 B2 * 6/2013 Li ..... E05B 65/006 292/34
2005/0247546 A1 * 11/2005 Strange ..... B23Q 7/1447 198/793
2006/0156903 A1 * 7/2006 Baird ..... G10H 1/348 84/453
2010/0165578 A1 * 7/2010 Kearns ..... H01L 23/40 361/719
2012/0007323 A1 * 1/2012 Janick ..... B60B 33/0007 280/47.34
2015/0375229 A1 * 12/2015 Possinger ..... B01L 3/502784 435/91.2

* cited by examiner

*Primary Examiner* — Suzanne L Barrett
(74) *Attorney, Agent, or Firm* — Plager Schack LLP; Mark H. Plager; Kara Verryt

(57) ABSTRACT

A locking apparatus with enhanced strength for use with a safe having a pivotably mounted door is provided. The locking apparatus includes a cam rotatably mounted to the door's rear wall and positioned within an internal cavity of the safe in the closed position, a plurality of arm members slidably mounted to the cam, and a shaft coupled to the cam. The shaft is maneuvered to rotate the cam in a first direction to permit the arm members to adjust to an extended position beyond a perimeter of the door within the safe's internal cavity, thereby locking the door in the closed position. The shaft is maneuvered to rotate the cam in a second direction to permit the arm members to adjust to a retracted position within the perimeter of the door, thereby unlocking the door and allowing pivotal movement of the door to the open position.

6 Claims, 4 Drawing Sheets

SAFE LOCKING APPARATUS WITH ENHANCED STRENGTH

RELATED APPLICATION

The application claims priority to provisional patent application U.S. Ser. No. 62/462,288 filed on Feb. 22, 2017, the entire contents of which is herein incorporated by reference.

BACKGROUND

The embodiments herein relate generally to locking mechanisms for safes.

Safes are lockable compartments used to secure valuable items and prevent damage and/or theft to them. Generally, each safe comprises a housing with a door and a locking mechanism used to secure the door in the locked position. Current mechanical locking mechanisms for safes comprise components that lack strength such as thin sheet metal, angle irons and round bars. In addition, current locking mechanisms are prone to jams, which cause the safe doors to remain locked. This creates a hassle for the user to unlock the jammed door.

As such, there is a need in the industry for a safe locking mechanism with enhanced strength and reliability that addresses the limitations of the prior art.

SUMMARY

A locking apparatus with enhanced strength for use with a safe is provided. The safe comprises a housing with a door pivotably mounted to an opening in the housing connected to an internal cavity. The door is configured to pivotably adjust to an open position to permit access to the internal cavity or a closed position to seal the internal cavity. The locking apparatus comprises a cam rotatably mounted to a rear wall of the door and positioned within the internal cavity of the safe in the closed position, a plurality of arm members slidably mounted to the cam, and a shaft coupled to the cam and extending through the door of the safe, wherein the shaft is maneuvered to rotate the cam in a first direction to permit the plurality of arm members to slidably adjust to an extended position away from the cam and beyond a perimeter of the door within the internal cavity, thereby locking the door in the closed position, wherein the shaft is maneuvered to rotate the cam in a second direction to permit the plurality of arm members to slidably adjust to a retracted position toward the cam within the perimeter of the door, thereby unlocking the door and allowing pivotal movement of the door to the open position.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
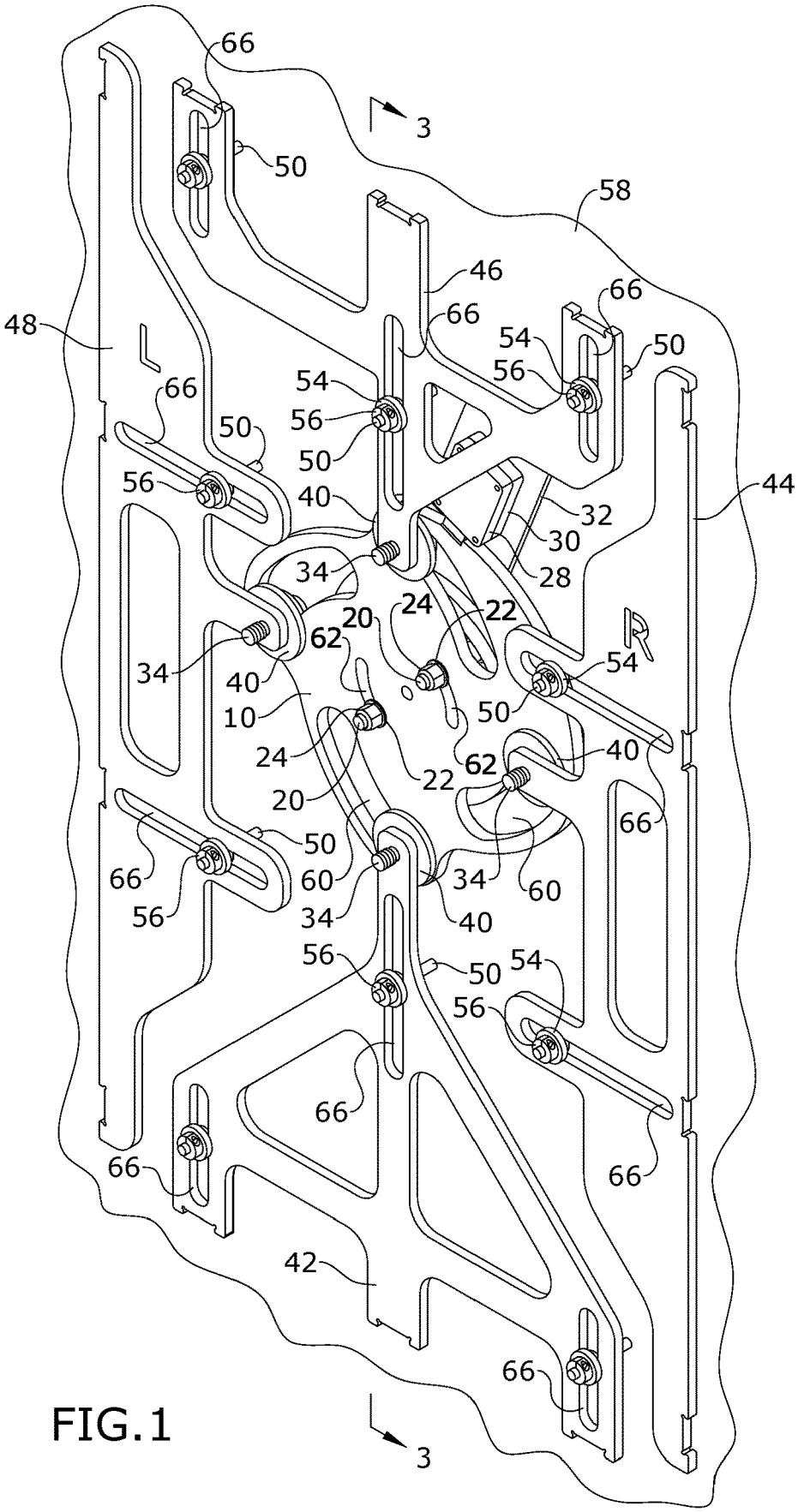
FIG. 1 depicts a perspective view of certain embodiments of the locking apparatus.
Figure 2:
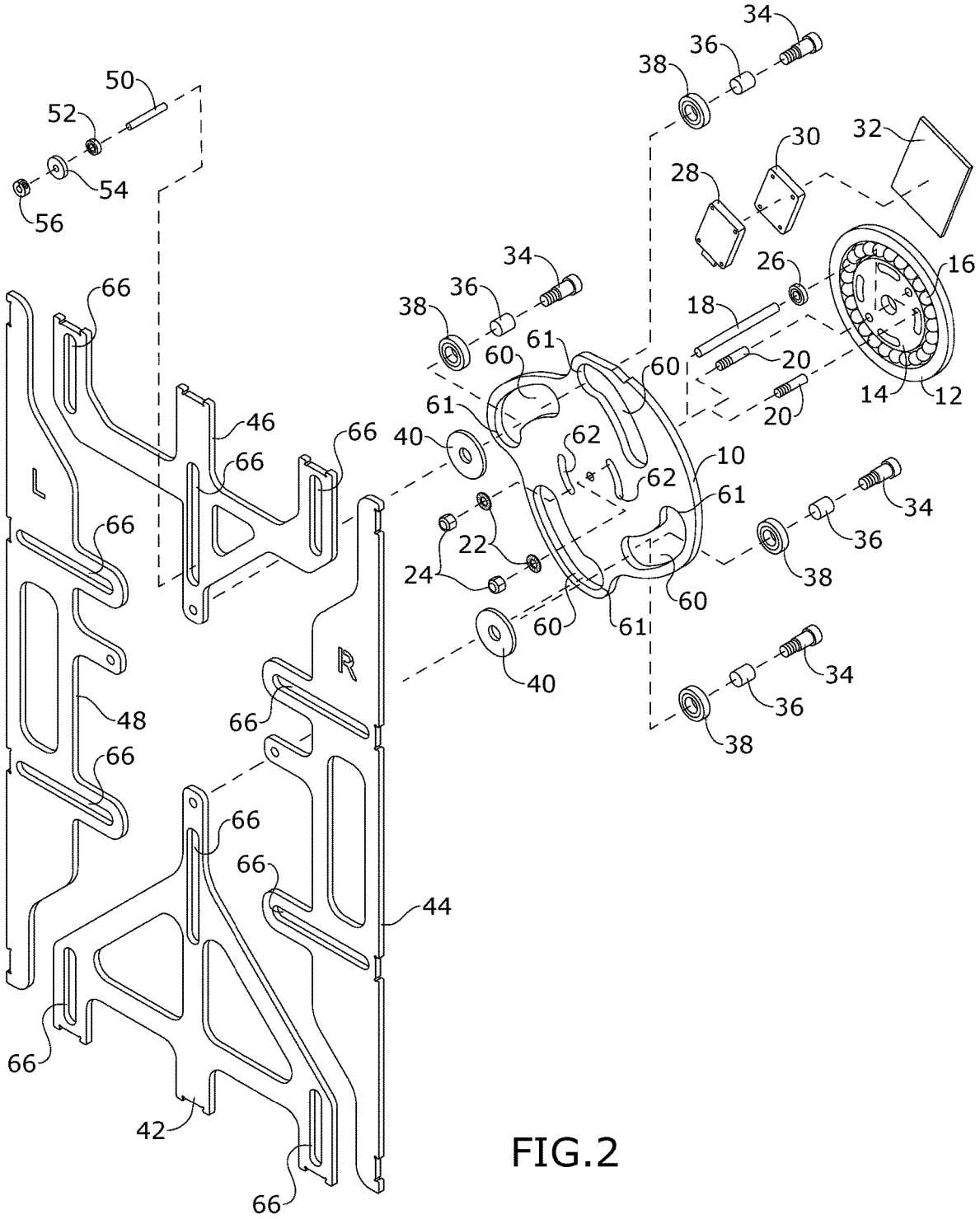
FIG. 2 depicts an exploded view of certain embodiments of the locking apparatus.

As depicted in FIGS. 1-2, the locking apparatus is configured for use with a safe to store a variety of items such as firearms or other valuables. In one embodiment, the safe generally comprises a housing with an opening that connects to an internal cavity, which is configured to store the variety of items. The safe comprises a door pivotably mounted to the opening of the housing by components such as hinge members. For illustrative purposes, embodiments of the invention focus on safe door 58, which the locking apparatus is attached thereto.

The locking apparatus generally comprises cam 10, a bearing assembly comprising outer race 12, inner hub 14 and ball bearings 16, and a plurality of arm members comprising bottom arm member 42, right arm member 44, top arm member 46 and left arm member 48. Components of the locking apparatus are preferably made from carbon steel. However, alternative materials known in the field such as stainless steel, aluminum, other metals or combinations of materials may be used instead. In one embodiment, the components of the locking apparatus are powdered coated to minimize corrosion from the presence of any moisture in the environment.

As depicted in FIGS. 1-4, cam 10 is rotatably mounted to the rear wall of safe door 58, which is positioned within the internal cavity of the safe when safe door 58 is in the closed position. In the closed position, safe door 58 seals the internal cavity of the safe.

Cam 10 generally comprises a member comprising a pair of inner curved slots 62 and a plurality of outer curved slots 60. In certain embodiments, cam 10 may comprise the shape of a square, circle, triangle, kidney or alternative shape. In certain embodiments, cam 10 is rotatably mounted to the bearing assembly, which is coupled to safe door 58. The bearing assembly comprises inner hub 14, a plurality of ball bearings 16 disposed around inner hub 14, and outer race 12 coupled to inner hub 14 and disposed around the plurality of ball bearings 16. In a preferred embodiment, the bearing assembly comprises 20 ball bearings 16 with each ball bearing being approximately ¾" in diameter. However, it shall be appreciated that an alternative number of ball bearings 16 may be used. In an alternative embodiment, each ball bearing 16 can have a diameter of 1⅛".

Figure 3:
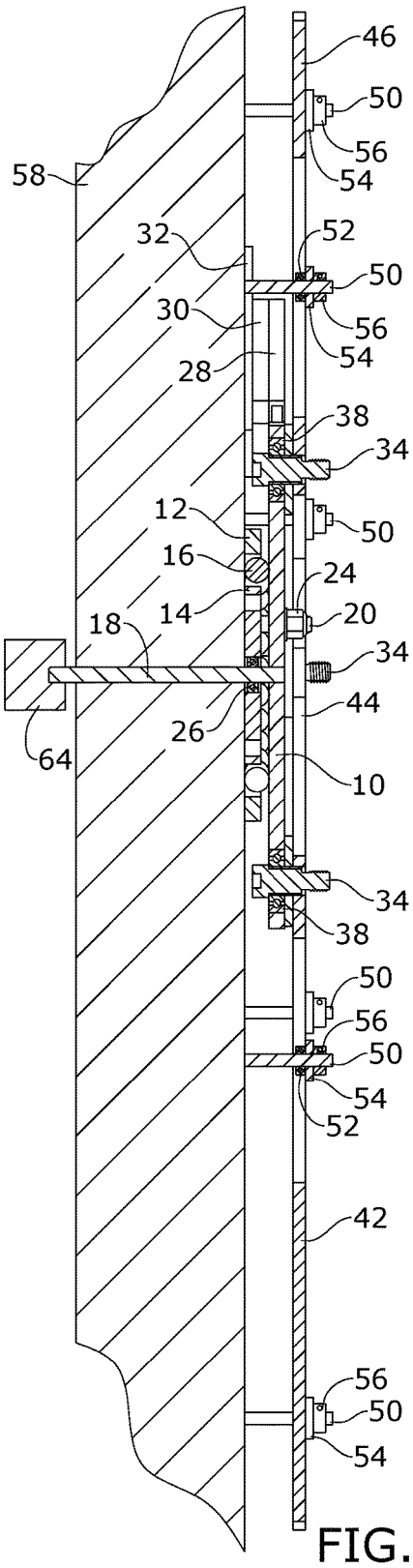
FIG. 3 depicts a section view of certain embodiments of the locking apparatus taken along line 3-3 in FIG. 1.
Figure 4:
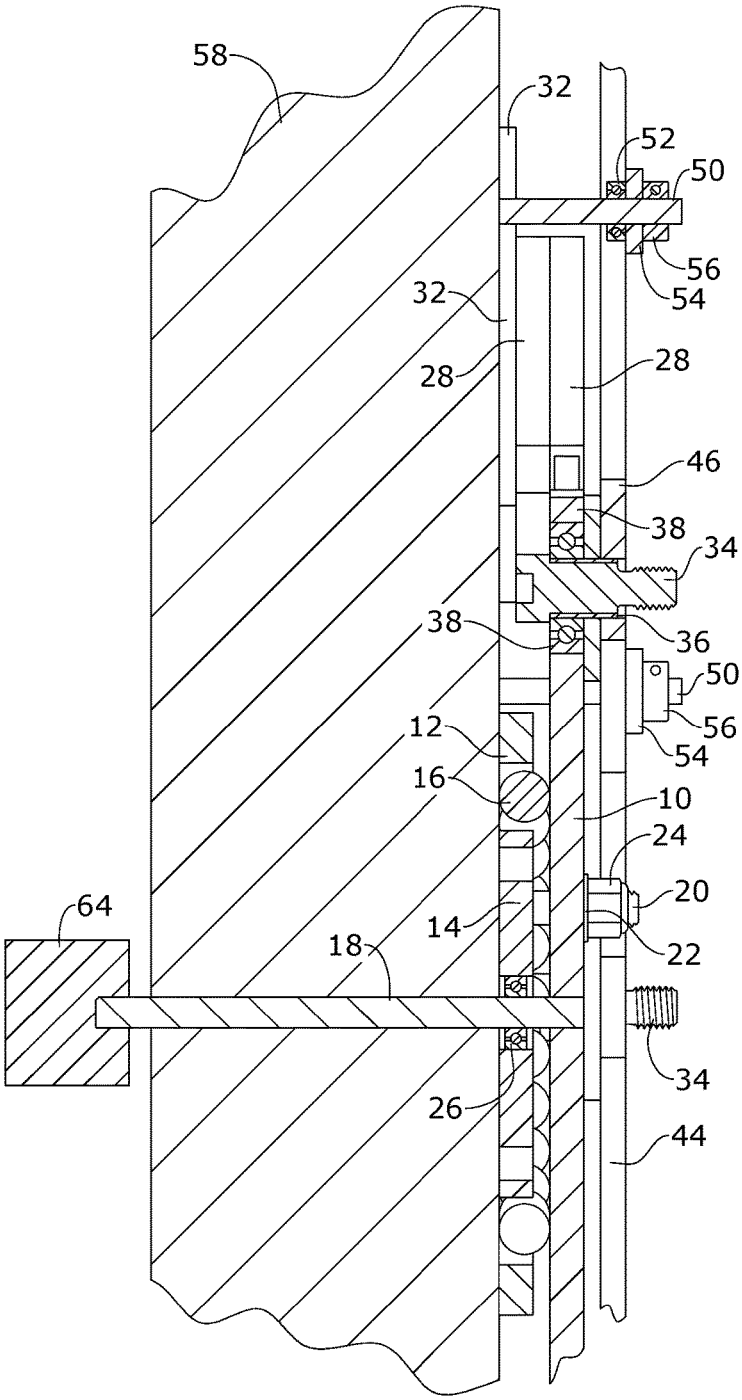
FIG. 4 depicts a section view of certain embodiments of the locking apparatus.

Inner hub 14 of the bearing assembly is welded to the rear wall of safe door 58 and comprises a central opening configured to receive cam roller bearing 26. In one embodiment, a single cam roller bearing 26 is disposed within the central opening of inner hub 14. However, it shall be appreciated that multiple cam roller bearings 26 can be stacked together and disposed within the central opening of inner hub 14. As depicted in FIGS. 2-4, cam shaft 18 comprises a first end welded to cam 10. Cam shaft 18 extends through cam roller bearing 26 within the central opening of inner hub 14 and extends through safe door 58. The second end of cam shaft 18 is exposed outside of safe door 58. In one embodiment, handle 64 is coupled to the second end of cam shaft 18. In a preferred embodiment, cam shaft 18 comprises a D-shape and an approximate diameter of ½".

A pair of threaded studs 20 are welded to inner hub 14 of the bearing assembly. The pair of threaded studs 20 extend through inner curved slots 62 of cam 10 and are secured in place by a pair of thrust washers 22 and a pair of lock nuts 24. In one embodiment, each thrust washer 22 comprises a brass washer impregnated with graphite. In this configuration, the rotation of cam 10 is limited by the motion of threaded studs 20 as they travel along the pathways within inner curved slots 62 in cam 10. Lock nuts 24 can be tightened or loosened as desired to adjust the tension and amount of resistance present in response to the rotation of cam 10.

The rotation of cam 10 can be controlled by handle 64 present outside of the safe. Since handle 64 is directly connected to cam shaft 18, the rotation of handle 64 rotates cam 10. In certain embodiments, a locking mechanism is configured to permit the free rotation of cam 10 in a first mode or prevent any rotational movement of cam 10 in a second mode. As depicted in FIG. 2, the locking mechanism comprises lock 28, lock base 30 and anti-drill plate 32. Lock 28 is bolted to lock base 30 by mechanical fasteners, which is welded to anti-drill plate 32. Anti-drill plate 32 is welded to the rear wall of safe door 58. In certain embodiments, lock 28 comprises a dead bolt lock or swing bolt lock. In one embodiment, lock 28 may be either an electronic or mechanical lock. In one embodiment, lock 28 is operably connected to an input mechanism (not shown) such as a keypad coupled to the front wall of safe door 58. In a locked configuration, lock 28 prevents the rotation of cam 10. Once a code is properly entered into the input mechanism, lock 28 permits the rotation of cam 10 as desired.

The plurality of arm members 42, 44, 46, 48 are slidably mounted to cam 10. In one embodiment, bottom arm member 42 is positioned proximate the bottom edge of safe door 58, right arm member 44 is positioned proximate a first side edge of safe door 58, top arm member 46 is positioned proximate a top edge of safe door 58, and left arm member 48 is positioned proximate a second side edge of safe door 58. Each arm member 42, 44, 46, 48 is slidably mounted to one of the plurality of outer curved slots 60 in cam 10.

As depicted in FIGS. 2-4, top arm member 46 is coupled to primary roller bearing 38 disposed within one of the plurality of outer curved slots 60 in cam 10. A primary set of fasteners comprising shoulder screw 34, bushing 36 and thrust washer 40 are used to secure top arm member 46 to outer curved slot 60. Primary roller bearing 38 comprises an inner diameter of approximately ¾", outer diameter of approximately 1⅞" and a central opening configured to receive bushing 36. Shoulder screw 34 is disposed through bushing 36, thrust washer 40 and an opening in top arm member 46. In this configuration, thrust washer 40 is disposed around shoulder screw 34 and in contact with both top arm member 46 and cam 10.

As cam 10 rotates, top arm member 46 slidably adjusts relative to cam 10. The movement of top arm member 46 is limited by the motion of primary roller bearing 38 as it travels along the pathway within outer curved slot 60 in cam 10. Although FIG. 2 depicts the primary sets of fasteners used to secure top and bottom arm members 46,42 to cam 10, it shall be appreciated that all arm members 42, 44, 46, 48 are coupled to corresponding outer curved slots 60 in cam 10 in the same manner. As a result, the rotation of cam 10 will slidably adjust all arm members 42, 44, 46, 48 simultaneously relative to cam 10.

Each arm member 42, 44, 46, 48 comprises a plurality of guide slots 66 in direct communication with the rear wall of safe door 58 by secondary sets of fasteners. In one embodiment, each secondary set of fasteners comprises alignment pin 50, secondary roller bearing 52, pin washer 54 and collar 56. With respect to top arm member 46 and one of the plurality of guide slots 66 as a reference, secondary roller bearing 52 is disposed within guide slot 66. Alignment pin 50 comprises a first end welded to the rear wall of safe door 58. Alignment pin 50 extends through secondary roller bearing 52 within guide slot 66 and pin washer 54. Alignment pin 50 is secured in place to guide slot 66 of top arm member 46 by collar 56. In this configuration, pin washer 54 is in contact with both secondary roller bearing 52 and collar 56.

Each guide slot 66 in arm members 42, 44, 46, 48 is coupled to the rear wall of safe door 58 by a corresponding secondary set of fasteners as previously described. As cam 10 rotates and arm members 42, 44, 46, 48 slidably adjust relative to cam 10, alignment pins 50 and associated secondary roller bearings 52 simultaneously travel within corresponding guide slots 66 in arm members 42, 44, 46, 48. The interaction of secondary roller bearings 52 and alignment pins 50 with guide slots 66 enhances the fluidity of motion of arm members 42, 44, 46, 48 as cam 10 rotates.

It shall be appreciated that arm members 42, 44, 46, 48 may have an alternative number of guide slots 66 in communication with secondary roller bearings 52 and alignment pins 50. In an alternative embodiment, the secondary set of fasteners may comprise different components. In one embodiment, each secondary set of fasteners comprises a steel block welded to the rear wall of safe door 58, a shoulder screw disposed within an opening in the steel block and extending through a bearing disposed in guide slot 66. As such, alternative fastening components may be used to connect arm members 42, 44, 46, 48 to safe door 58.

Figure 5:
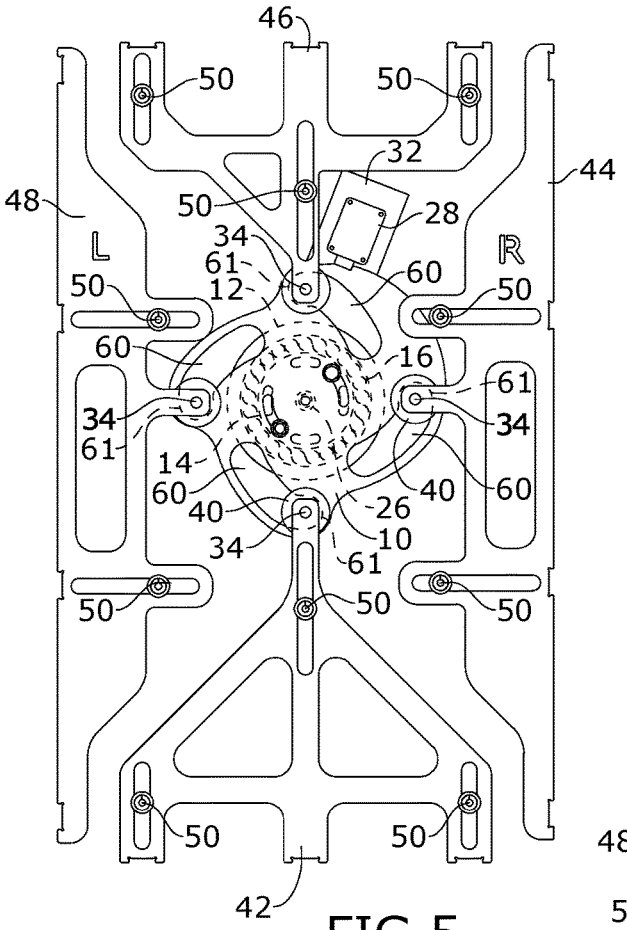
FIG. 5 depicts a front view of certain embodiments of the locking apparatus in a locked position with safe door 58 not shown to improve clarity of the other components.

In operation of the locking apparatus, a user maneuvers cam 10 via handle 64 when safe door 58 is closed. Once a code is properly entered into the input mechanism such as a keypad on the safe, lock 28 enables the rotation of cam 10 as desired. The user rotates handle 64 in a first direction to rotate cam shaft 18 and cam 10 in the first direction. This permits arm members 42, 44, 46, 48 to slidably adjust simultaneously to an extended position away from cam 10 and beyond a perimeter of safe door 58 within the internal cavity as depicted in FIG. 5. Arm members 42, 44, 46, 48 in the extended position within the internal cavity of the safe serve as an obstruction that prevents safe door 58 from pivotably adjusting to the open position. As a result, safe door 58 remains locked in the closed position.

Figure 6:
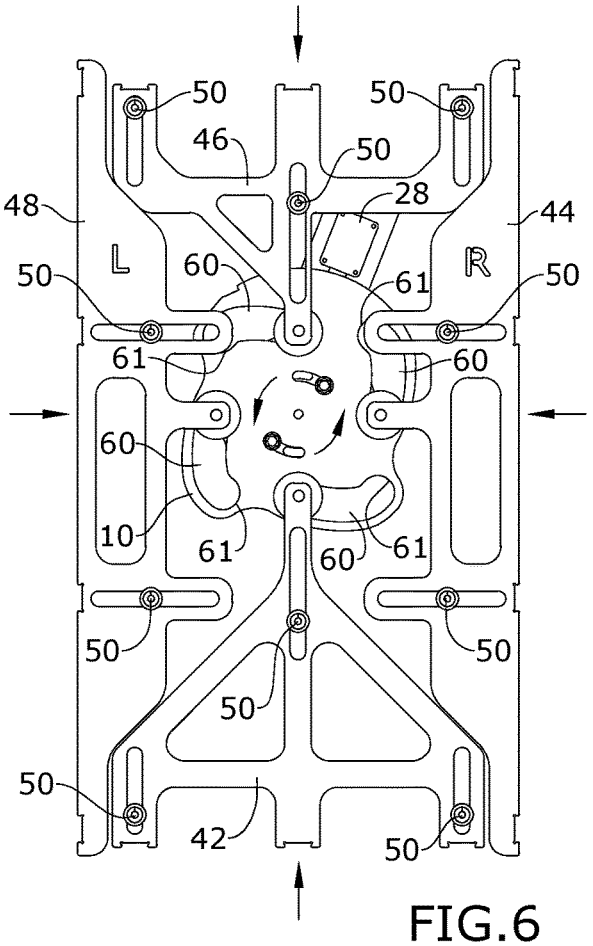
FIG. 6 depicts a front view of certain embodiments of the locking apparatus in an unlocked position with safe door 58 not shown to improve clarity of the other components.

The user rotates handle 64 in a second direction to rotate cam shaft 18 and cam 10 in the second direction. This permits arm members 42, 44, 46, 48 to slidably adjust simultaneously to a retracted position toward cam 10 within the perimeter of safe door 58 as depicted in FIG. 6. This unlocks safe door 58 and allows pivotal movement of safe door 58 to the open position. The user can easily maneuver handle 64 to control the rotation of cam 10 and arm members 42, 44, 46, 48 as needed.

In one embodiment as depicted in FIGS. 5-6, the plurality of outer curved slots 60 in cam 10 of the locking apparatus comprises a plurality of seated portions 61 that interact with primary roller bearings 38. In the locked position with safe door 58 closed, primary roller bearings 38 rest in the plurality of seated portions 61 in curved slots 60 of cam 10. This enhances stability and strength of the locking apparatus as forceful blows to safe door 58 such as from a hammer will not cause arm members 42, 44, 46, 48 to collapse and allow safe door 58 to open. During authorized use of the locking apparatus, the rotation of cam 10 causes primary roller bearings 38 to pop out of the plurality of seated portions 61 in curved slots 60 of cam 10, and the operation/movement of the components of the locking apparatus are performed as previously discussed.

It shall be appreciated that the components of the locking apparatus described in several embodiments herein may comprise any alternative known materials in the field and be of any color, size and/or dimensions. It shall be appreciated that the components of the locking apparatus described herein may be manufactured and assembled using any known techniques in the field. In alternative embodiments, the locking apparatus can be reconfigured to fit any sized safe door. This is accomplished by increasing or decreasing the size of the apparatus' components. This locking apparatus can replace more expensive locking mechanisms and achieve the reliability and safety one would expect in a safe.

Persons of ordinary skill in the art may appreciate that numerous design configurations may be possible to enjoy the functional benefits of the inventive systems. Thus, given the wide variety of configurations and arrangements of embodiments of the present invention, the scope of the invention is reflected by the breadth of the claims below rather than narrowed by the embodiments described above.

What is claimed is:

1. A locking apparatus with enhanced strength for use with a safe, the safe comprising a housing with a door pivotably mounted to an opening in the housing connected to an internal cavity, the door configured to pivotably adjust to an open position to permit access to the internal cavity or a closed position to seal the internal cavity, the locking apparatus comprising:

a cam comprising a plurality of outer curved slots and rotatably mounted to a rear wall of the door, the cam positioned within the internal cavity of the safe in the closed position;

a plurality of arm members slidably mounted to the cam, each arm member in the plurality of arm members being in direct communication with one of the plurality of outer curved slots in the cam, each arm member in the plurality of arm members coupled to a primary roller bearing disposed within one of the plurality of outer curved slots of the cam by a primary set of fasteners, the primary roller bearing configured to travel within the outer curved slot to enable the arm member to slidably adjust to an extended position or a retracted position, each arm member in the plurality of arm members comprising at least one guide slot disposed therethrough and in direct communication with the rear wall of the door by a secondary set of fasteners;

a shaft coupled to the cam and extending through the door of the safe; and a bearing assembly connecting the cam to the door, the bearing assembly comprising:

a hub coupled to the rear wall of the door;

a plurality of ball bearings disposed around the hub; and an outer race coupled to the hub and disposed around the plurality of ball bearings, wherein:

the shaft is maneuvered to rotate the cam in a first direction to permit the plurality of arm members to slidably adjust to the extended position away from the cam and beyond a perimeter of the door within the internal cavity, thereby locking the door in the closed position, the shaft is maneuvered to rotate the cam in a second direction to permit the plurality of arm members to slidably adjust to the retracted position toward the cam within the perimeter of the door, thereby unlocking the door and allowing pivotal movement of the door to the open position, and the hub comprises an opening with a cam roller bearing disposed thereto configured to permit the shaft to extend therethrough.

2. The locking apparatus of claim 1, wherein the primary set of fasteners comprises a bushing disposed within the primary roller bearing, a shoulder screw disposed through the bushing and the one of the plurality of arm members, and a washer disposed around the shoulder screw and in contact with the one of the plurality of arm members and the cam.

3. The locking apparatus of claim 1, wherein the secondary set of fasteners comprises a secondary roller bearing disposed within the guide slot, an alignment pin coupled to the rear wall of the door and extending through the secondary roller bearing, a washer disposed around the alignment pin and in contact with the secondary roller bearing, and a collar disposed around the alignment pin and in contact with the washer.

4. The locking apparatus of claim 1, further comprising a pair of studs coupled to the hub of the bearing assembly and in direct communication with the cam.

5. The locking apparatus of claim 4, wherein the cam comprises a pair of inner curved slots, each inner curved slot in the pair of inner curved slots in direct communication with one of the pair of studs.

6. The locking apparatus of claim 5, wherein each stud in the pair of studs extends through one of the pair of inner curved slots in the cam and is coupled thereto by a washer and a lock nut.

* * * * *